US010493448B2

(12) United States Patent
Price et al.

(10) Patent No.: US 10,493,448 B2
(45) Date of Patent: Dec. 3, 2019

(54) ASSAY CARTRIDGE

(71) Applicant: Bio-Rad Laboratories, Inc., Hercules, CA (US)

(72) Inventors: Glenn Price, Martinez, CA (US); Chris Charlton, Martinez, CA (US); William Link, El Cerrito, CA (US); Robert Alan Iovanni, Vallejo, CA (US); Anthony F. Prestigiacomo, Emeryville, CA (US)

(73) Assignee: Bio-Rad Laboratories, Inc., Hercules, CA (US)

( * ) Notice: Subject to any disclaimer, the term of this patent is extended or adjusted under 35 U.S.C. 154(b) by 628 days.

(21) Appl. No.: 15/064,365

(22) Filed: Mar. 8, 2016

(65) Prior Publication Data

US 2016/0266099 A1 Sep. 15, 2016

Related U.S. Application Data

(60) Provisional application No. 62/132,984, filed on Mar. 13, 2015.

(51) Int. Cl.
*B01L 3/00* (2006.01)
*B01L 9/00* (2006.01)

(52) U.S. Cl.
CPC ..... *B01L 3/5023* (2013.01); *B01L 3/5025* (2013.01); *B01L 3/52* (2013.01); *B01L 9/527* (2013.01);

(Continued)

(58) Field of Classification Search
CPC ..... B01L 2300/087; B01L 2300/0877; B01L 2200/0621; B01L 2200/16;

(Continued)

(56) References Cited

U.S. PATENT DOCUMENTS 5,162,237 A 11/1992 Messenger et al.
5,912,134 A 6/1999 Shartle (Continued)

FOREIGN PATENT DOCUMENTS

WO 03/083491 A2 10/2003

OTHER PUBLICATIONS

PCT/US2016/021505, "International Search Report and Written Opinion", dated May 16, 2016, 9 pages.

(Continued)

*Primary Examiner* — Lyle Alexander
*Assistant Examiner* — Bryan Kilpatrick
(74) *Attorney, Agent, or Firm* — Kilpatrick Townsend & Stockton LLP

(57) ABSTRACT

In one arrangement, a cartridge includes a cartridge body defining a holding compartment, first and second fractioning compartments, and a number of flow channels formed within the cartridge body. A predetermined quantity of fluid can be held in the holding compartment when the cartridge body is held in a first orientation, and can be poured from the holding compartment to the first fractioning compartment by rotating the cartridge body about a predefined rotation axis to a second orientation, spilling the fluid from the holding compartment to the first fractioning compartment through one of the flow channels. The first fractioning compartment is such that when the cartridge body is in the second orientation, not all of the fluid can be contained in the first fractioning compartment, and fluid that overflows the first fractioning compartment flows through a second flow channel to the second fractioning compartment.

16 Claims, 15 Drawing Sheets

(52) U.S. Cl.
CPC . *B01L 2200/027* (2013.01); *B01L 2200/0621* (2013.01); *B01L 2200/143* (2013.01); *B01L 2200/16* (2013.01); *B01L 2300/044* (2013.01); *B01L 2300/069* (2013.01); *B01L 2300/0672* (2013.01); *B01L 2300/087* (2013.01); *B01L 2300/0867* (2013.01); *B01L 2300/0877* (2013.01); *B01L 2400/0457* (2013.01)

(58) Field of Classification Search
CPC ..... B01L 2300/044; B01L 2300/0672; B01L 2400/0457; B01L 3/5023; B01L 3/52; Y10T 436/2575; Y10T 137/86533; Y10T 137/86863
See application file for complete search history.

(56) References Cited

U.S. PATENT DOCUMENTS 6,632,399 B1 * 10/2003 Kellogg ..... B01F 13/0059 422/505
2002/0048535 A1 4/2002 Weigl et al.
2003/0211010 A1 11/2003 Nagaoka et al.
2004/0137607 A1 7/2004 Tanaami et al.
2005/0026301 A1 2/2005 Petithory
2005/0178218 A1 * 8/2005 Montagu ..... B01L 3/50273 73/864.34
2009/0169430 A1 * 7/2009 Yamamoto ..... B01L 3/50273 422/72
2010/0055766 A1 3/2010 Hwang et al.
2012/0021447 A1 * 1/2012 Garcia Da Fonseca ..... B01L 3/50273 435/24
2013/0121898 A1 5/2013 Chen et al.

OTHER PUBLICATIONS

Extended European Search Report in EP 16765440.9 dated Jul. 2, 2018; 9 pages.
Communication pursuant to Article 94(3) EPC dated May 6, 2019 in EP Patent Application No. 16765440.9. 7 pages.

* cited by examiner

ASSAY CARTRIDGE

This application claims the benefit of U.S. Provisional Patent Application No. 62/132,984, filed Mar. 13, 2015, and titled "Assay Cartridge", the entire disclosure of which is hereby incorporated by reference herein for all purposes.

BACKGROUND OF THE INVENTION

A wide variety of systems and methods exist for performing biochemical analysis, for example for medical testing. A common technique is to load analytes and reagents into a microfluidic "chip" that has fluid flow channels and other structures formed in it using photolithography techniques. Such a chip may include pumps, reservoirs, valves, mixing structures, and other features useful in the performance of a certain tests.

Typically, such a chip is controlled by an external controller, through application and release of fluid pressure at key points in the chip. For example, a valve may be formed by crossing a fluid flow channel in a soft medium with a dead-end cross channel. By pressurizing the cross channel, the fluid flow channel can be pinched off, and by releasing the pressure in the cross channel, the fluid flow channel is allowed to re-open. A peristaltic pump may be formed by placing three or more such valves close together crossing a fluid flow channel in a soft medium. By sequentially pressurizing and depressurizing the valves channels to pinch off and re-open adjacent locations in the fluid flow channel, fluid can be caused to flow in the fluid flow channel.

Because of the need for complex external pressure control, such microfluidic chips are not convenient for use in routine medical testing, especially in remote locations.

BRIEF SUMMARY OF THE INVENTION

According to one aspect, a cartridge for fluid manipulation comprises a cartridge body defining a holding compartment and first and second fractioning compartments formed within the cartridge body. The cartridge body also defines a number of flow channels formed within the cartridge body. The compartments and flow channels are arranged such that a predetermined quantity of fluid can be held in the holding compartment when the cartridge body is held in a first orientation, and can be poured from the holding compartment to the first fractioning compartment by rotating the cartridge body about a predefined rotation axis to a second orientation, to spill the fluid from the holding compartment to the first fractioning compartment through a first one of the flow channels. The first fractioning compartment is of a shape, size, and position such that when the cartridge body is in the second orientation, not all of the fluid can be contained in the first fractioning compartment. The first fractioning compartment is connected to the second fractioning compartment by a second one of the flow channels, such that any of the fluid that overflows the first fractioning compartment when the cartridge body is in the second orientation flows through the second flow channel to the second fractioning compartment.

In some embodiments, the first and second fractioning compartments are shaped, sized, and positioned such that the predetermined quantity of fluid can be held in substantially equal quantities in the first and second fractioning compartments when the cartridge body is held in the second orientation. In some embodiments, the cartridge body defines a third fractioning compartment; the first and second fractioning compartments are shaped, sized, and positioned such that the predetermined quantity of fluid cannot be contained within the first and second fractioning compartments when the cartridge body is in the second orientation; and the second fractioning compartment is connected by a third one of the flow channels to the third fractioning compartment, such that any of the fluid that overflows the second fractioning compartment when the cartridge body in the second orientation flows through the third flow channel to the third fractioning compartment. In some embodiments, the first, second, and third fractioning compartments are shaped, sized, and positioned such that the predetermined quantity of fluid can be held in substantially equal quantities in the first, second, and third fractioning compartments when the cartridge body is held in the second orientation. In some embodiments, the cartridge further comprises two analysis areas, one analysis area respectively for each fractioning compartment, wherein the analysis areas are connected directly or indirectly to the respective fractioning compartments by respective ones of the flow channels, and the analysis areas are positioned such that fluid held in the fractioning compartments when the cartridge body is in the second orientation can be delivered to the respective analysis areas by one or more subsequent rotations of the cartridge body about the rotation axis, to spill fluid from the fractioning compartments and into the respective connections to the analysis areas. In some embodiments, the cartridge body further defines two mixing compartments, one mixing compartment respectively for each fractioning compartment, and wherein the fluid spilled from the fractioning compartments passes through the respective mixing compartments before reaching the respective analysis areas. In some embodiments, each of the mixing compartments stores a quantity of a reagent positioned to mix with the fluid spilled from the respective fractioning compartment before the fluid flows to the respective analysis area. In some embodiments, the fluid is a first fluid; the cartridge body further defines a second set of compartments and flow channels for manipulating a second fluid in sequence through the second set of compartments in reaction to the rotations of the cartridge about the rotation axis; the cartridge body further defines a second set of outlet channels respectively connecting the last of the second set of compartments with the analysis areas; and the second set of compartments and flow channels and the outlet channels are shaped, sized, and positioned such that the second fluid reaches the analysis areas later than the first fluid when the cartridge is rotated in such a way as to deliver the first fluid to the analysis areas. In some embodiments, the lengths of the outlet channels are selected to ensure that the second fluid will reach the analysis areas later than the first fluid.

According to another aspect, a cartridge for fluid manipulation comprises a cartridge body. The cartridge body defines a first set of compartments and flow channels for manipulating a first fluid. The compartments and channels in the first set are sized, shaped, and positioned such that a sequence of rotations of the cartridge body about a predefined rotation axis will cause a quantity of the first fluid to sequentially pass through all of the compartments in the first set via the first set of flow channels to reach an outlet of the first set of compartments and flow channels. The cartridge body defines a second set of compartments and flow channels for manipulating a second fluid. The compartments and channels in the second set are sized, shaped, and positioned such that the same sequence of rotations of the cartridge body about the predefined rotation axis will cause a quantity of the second fluid to sequentially pass through all of the compartments in the second set via the second set of flow channels to reach an outlet of the second set of compartments and flow channels. In some embodiments, the outlets of the first and second sets of compartments and flow channels are joined at a junction, and the first and second sets of compartments and flow channels are shaped, sized, and positioned such that the second fluid reaches the junction at a different time than the first fluid in response to the sequence of rotations. In some embodiments, the cartridge further comprises: a reservoir holding a sample fluid and a washing buffer fluid in separate compartments of the reservoir, the reservoir including two openings sealed by puncturable sealing covers; two hollow piercing elements positioned on the cartridge body such that the two piercing elements pierce the puncturable sealing covers of the reservoir when the reservoir is joined to the cartridge body, enabling the sample fluid and the washing buffer fluid to pass through the two hollow piercing elements and to pass respectively to the first set of compartments and flow channels and the second set of compartments and flow channels, the sample fluid being the first fluid and the washing buffer fluid being the second fluid; and an analysis area at the junction; wherein at least some of the compartments in the first set of compartments store quantities of reagents for mixing with the sample fluid as the sample fluid traverses the first set of compartments and flow channels, the reagents usable to conduct an assay of the sample fluid; and wherein the analysis area enables reading of a result of the assay. In some embodiments, the analysis area comprises an absorbent medium through which the sample fluid and the washing buffer fluid can sequentially transport by capillary action.

According to another aspect, a testing system comprises a cartridge for fluid manipulation as in claim 1, a motorized mechanism for producing a rotary motion of cartridge about a rotational axis, and a controller having a processor and memory. The controller is coupled to the motorized mechanism and programmed to cause the motorized mechanism to produce a predetermined series of rotations of cartridge in accordance with a predetermined assay.

According to another aspect, a method of conducting an assay comprises providing a cartridge having a cartridge body defining a holding compartment and first and second fractioning compartments formed within the cartridge body. The cartridge body also defines a number of flow channels formed within the cartridge body. The method further comprises placing a quantity of fluid in the holding compartment and holding the cartridge body in a first orientation, and rotating the cartridge about a predefined rotation axis to a second orientation to pour at least some of the fluid from the holding compartment through a first one of the flow channels to the first fractioning compartment. The first fractioning compartment is of a shape, size, and position such that when the cartridge body is in the second orientation, not all of the fluid can be contained in the first fractioning compartment. The first fractioning compartment is connected to the second fractioning compartment by a second one of the flow channels, such that any of the fluid that overflows the first fractioning compartment when the cartridge body is in the second orientation flows through the second flow channel to the second fractioning compartment. In some embodiments, the method further comprises rotating the cartridge about the rotation axis to one or more subsequent orientations, causing the fluid to spill from the two fractioning compartments to reach respective analysis areas in the cartridge. In some embodiments, the method further comprises pausing between successive rotations of the cartridge to allow an analyte in the fluid to react with a reagent previously stored in one of the compartments. In some embodiments, the rotation axis is a first rotation axis, the method further comprising rotating the cartridge about a second rotation axis different from the first. The method may further comprise depositing an analyte in the quantity of fluid. In some embodiments, depositing the analyte in the quantity of fluid comprises injecting the analyte through a puncturable seal.

DETAILED DESCRIPTION OF THE INVENTION

Figure 1:
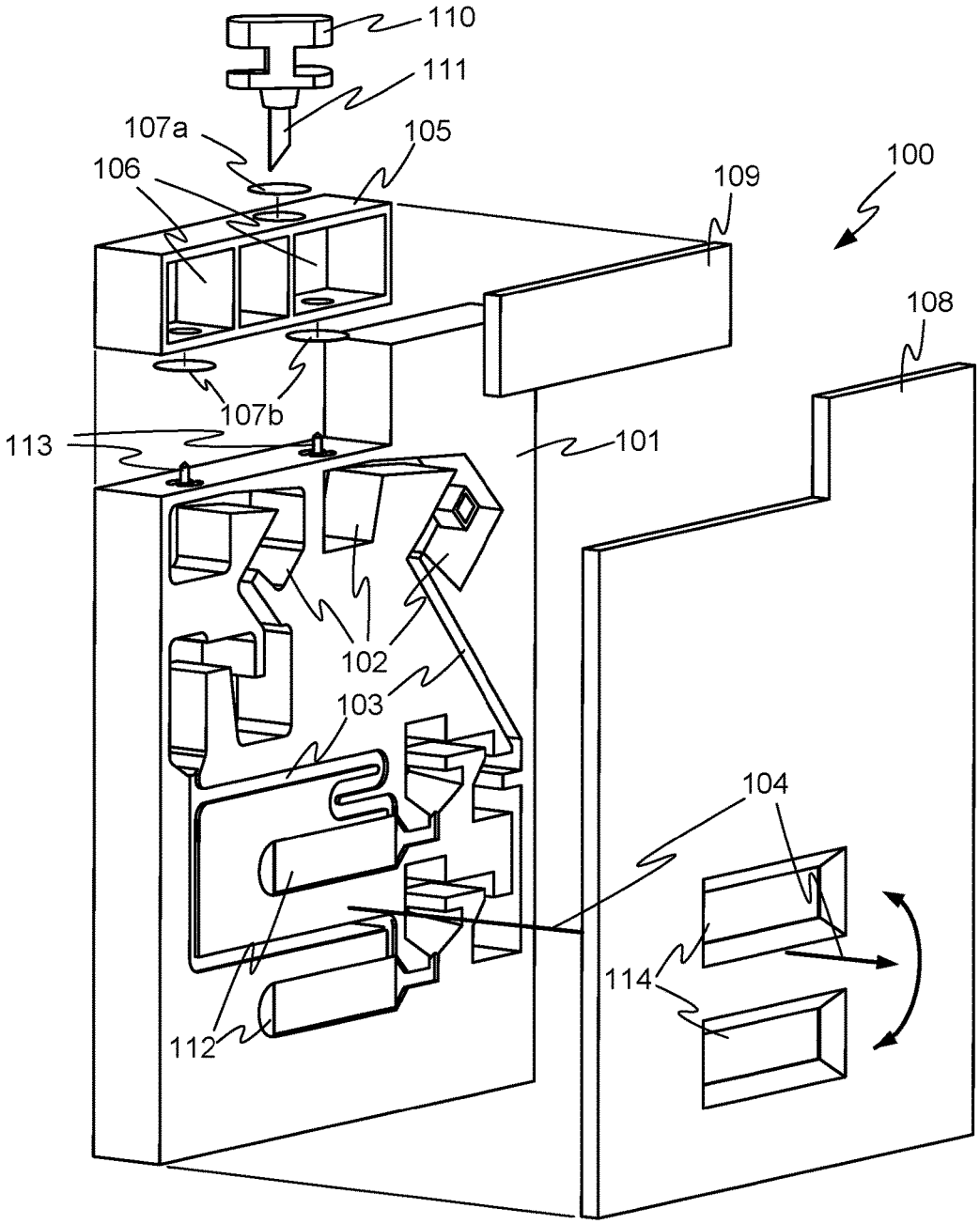
FIG. 1 illustrates an oblique exploded view of a cartridge for fluid manipulation, in accordance with embodiments of the invention.

FIG. 1 illustrates an oblique exploded view of a cartridge 100 for fluid manipulation, in accordance with embodiments of the invention. Cartridge 100 includes a cartridge body 101, in which are formed a number of compartments 102 and fluid flow channels 103 connecting the compartments 102 and other structures. Compartments 102 and fluid flow channels 103 are shaped, sized, and positioned to accomplish certain fluid manipulations when cartridge 100 is rotated about axis 104, as is explained in more detail below. Cartridge body 101 may be machined, molded, printed, or otherwise fabricated from any suitable material, for example a biocompatible polymer.

Cartridge 100 further includes a reservoir 105 having multiple isolated compartments 106. Compartments 106 may be used to hold fluids to be manipulated in cartridge 100. For example, one compartment may be loaded with a sample fluid for carrying an analyte, and another of compartments 106 may be loaded with a washing buffer fluid. Puncturable seals 107*a*, 107*b* may be placed over openings in reservoir 105, to retain the pre-loaded fluids. For example, cover 109 and puncturable seal 107*a* may be placed on reservoir 105, and the fluids loaded through the remaining openings in reservoir 105 (shown at the bottom of reservoir 105 in FIG. 1). Puncturable seals 107*b* may then be put in place to seal reservoir 105 in preparation for a particular test. Cover 108 is also placed over cartridge body 101, to seal the various structures of cartridge body 101.

A specimen containing an analyte may be introduced to the sample fluid using a sample injector 110. For example, sample injector may include a sharp hollow needle or similar structure 111 for puncturing puncturable seal 107*a* and carrying the analyte to reservoir 105. In some embodiments, the specimen may be a human blood sample and cartridge 100 is configured to perform an assay for glycated hemoglobin (HbA1c), useful in diagnosing and monitoring diabetes and capable of detecting the presence of variant forms of hemoglobin that are relevant to HbA1c measurements. It will be recognized that the invention may be embodied in many other ways as well. Example cartridge 100 also includes analysis areas 112, as will be explained in more detail below. Cover 108 may include viewing windows 114 for viewing analysis areas 112 from outside cartridge 100. In other embodiments, cover 108 may be made of a transparent material such as glass or a transparent polymer, to allow viewing of analysis areas 112.

Example cartridge body 101 also includes two hollow piercing elements 113 positioned to pierce puncturable seals 107*b* when reservoir 105 is mated to cartridge body 101, and to carry the respective fluids from reservoir compartments 106 to cartridge body compartments 102.

FIGS. 2-10 illustrate the use and operation of cartridge 100, to perform one example kind of assay. In these figures, covers 108 and 109 have been removed to show the internal workings of cartridge 100.

Figure 2:
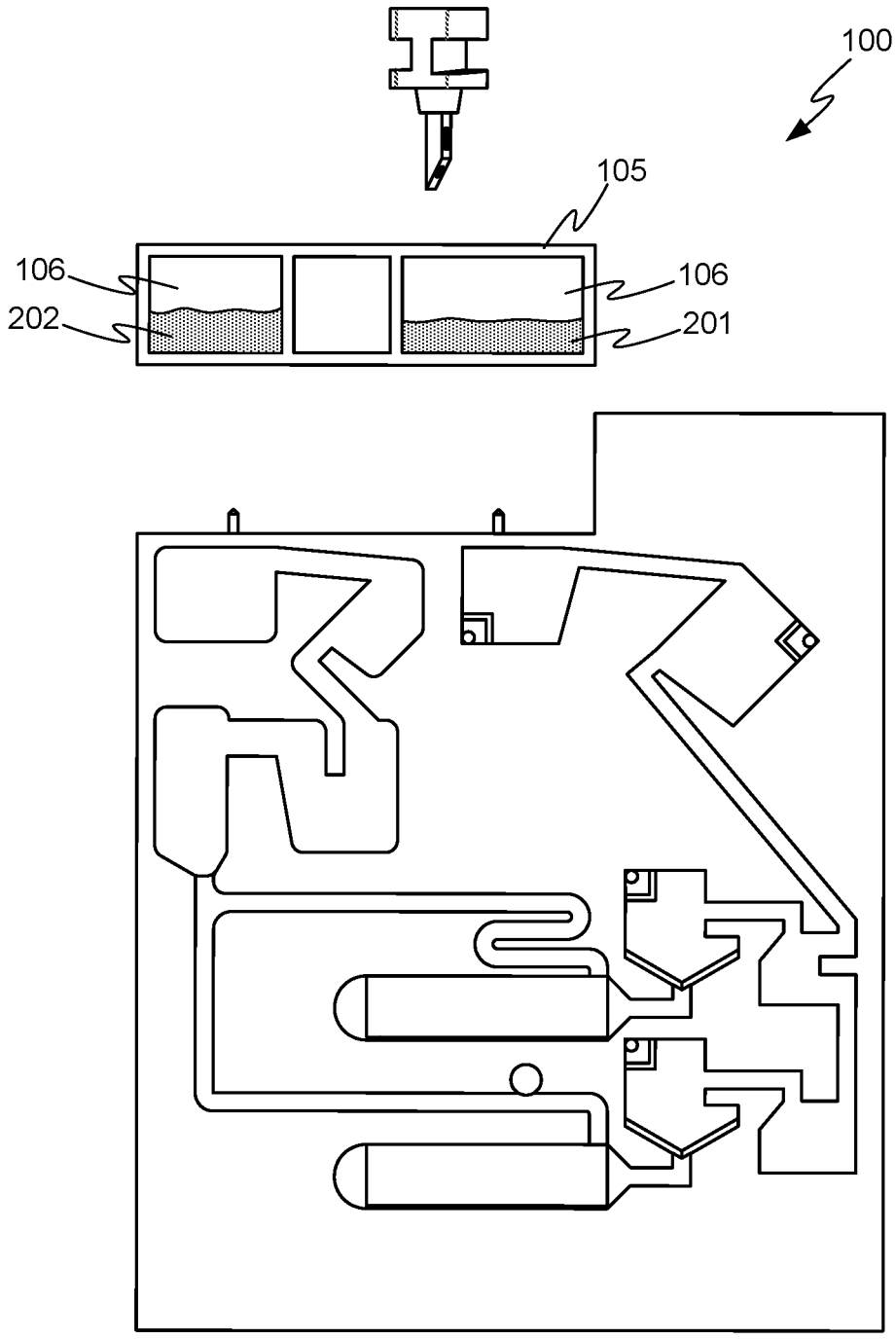
FIG. 2 illustrates a pre-loaded reservoir, in accordance with embodiments of the invention.

In FIG. 2, respective compartments 106 of reservoir 105 have been pre-loaded with a sample fluid 201 and a washing buffer fluid 202. Puncturable seals 107*a* and 107*b* are in place to seal reservoir 105. The types and quantities of fluids 201 and 202 may be selected in accordance with the particular test being conducted.

Figure 3:
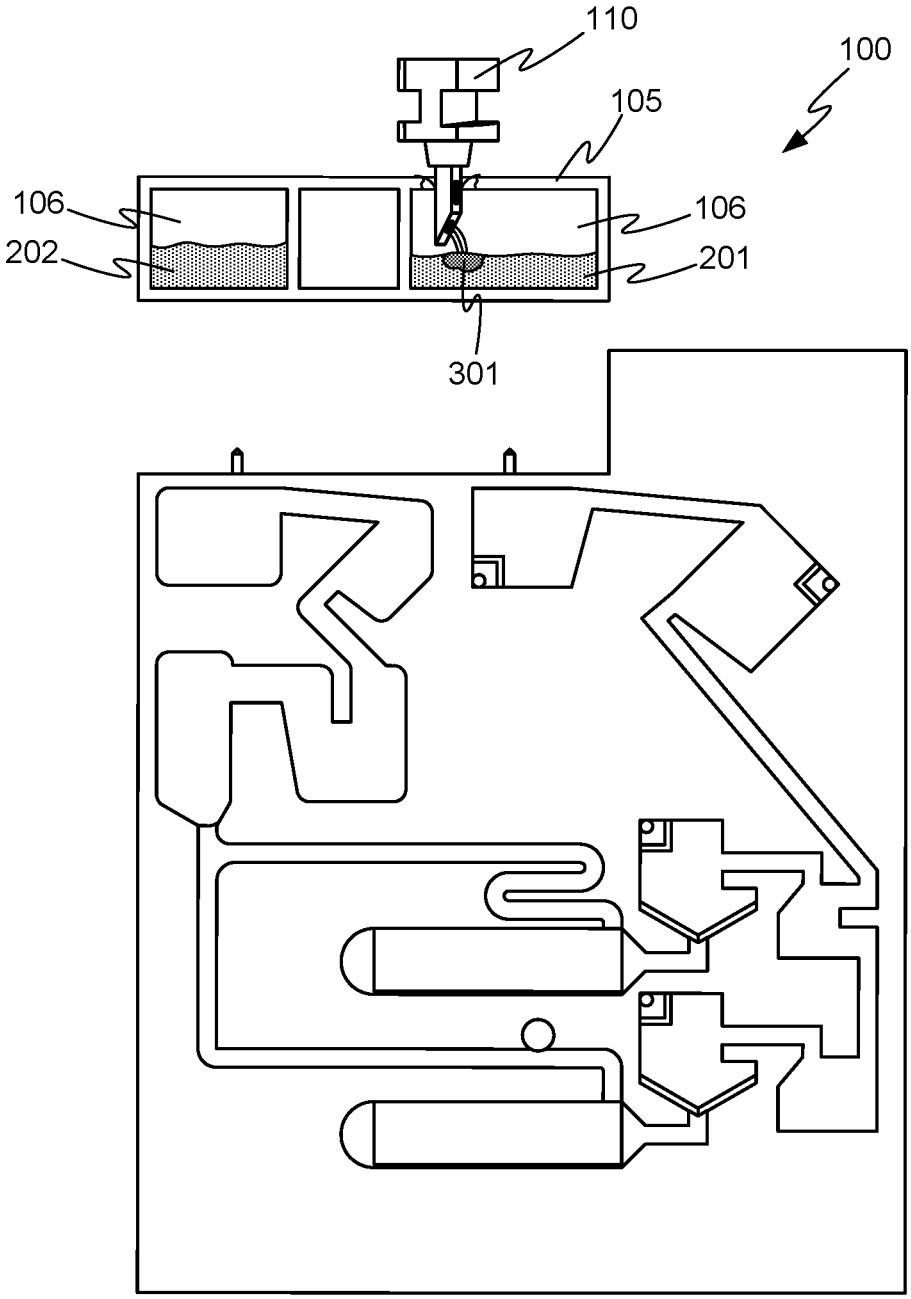
FIG. 3 illustrates a sample injection into the reservoir of FIG. 2, in accordance with embodiments of the invention.

In FIG. 3, sample injector 110 has pierced puncturable seal 107*a*, and provides an analyte 301 to mix with sample fluid 201.

Figure 4:
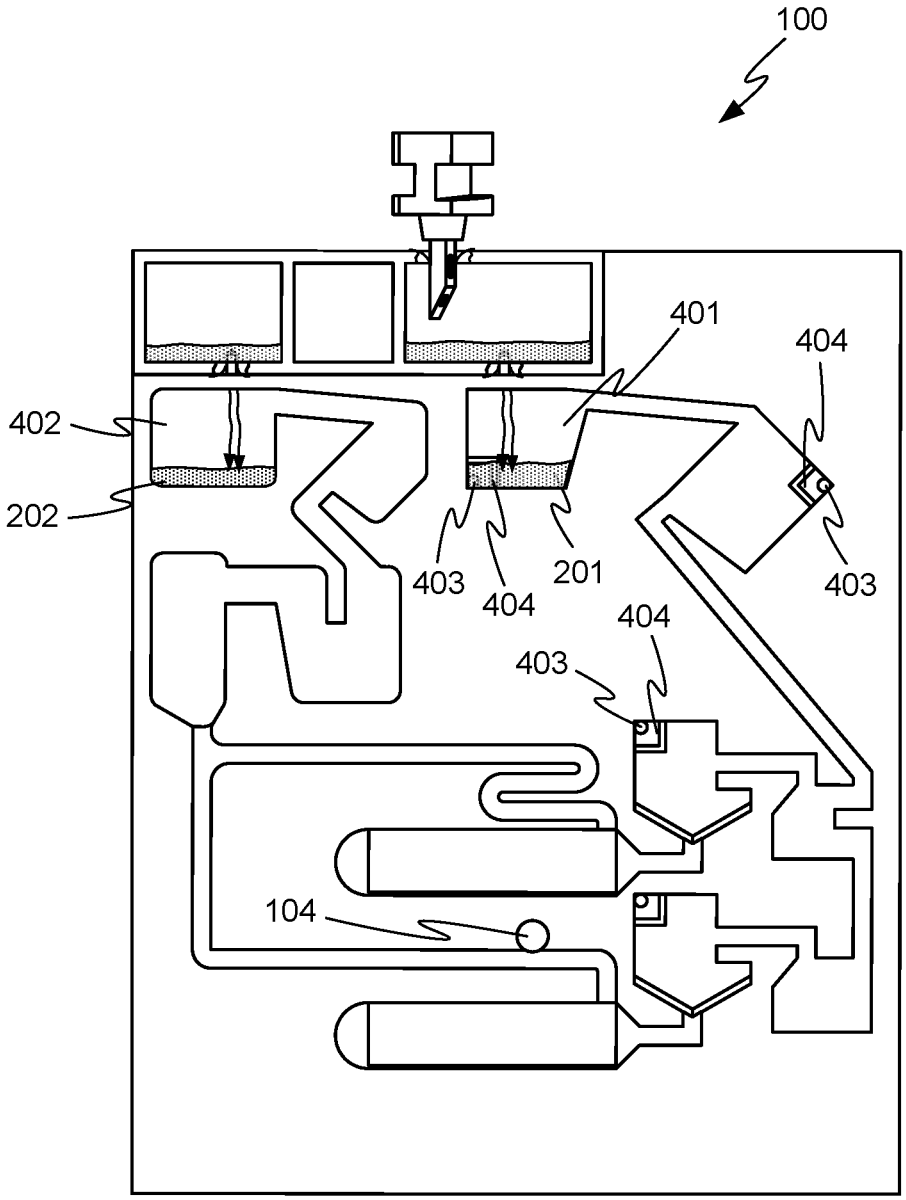
FIG. 4 illustrates the reservoir of FIG. 2 joined to a cartridge body, in accordance with embodiments of the invention.

As is shown in FIG. 4, once the analyte has mixed with sample fluid 201, reservoir 105 is joined with cartridge body 101, such that hollow piercing elements 113 puncture puncturable seals 107*b* and allow the sample fluid 201 and washing buffer fluid 202 to flow into respective compartments 401 and 402 of cartridge body 101. As is also visible in FIG. 4, at least some compartments in cartridge body 101 may be pre-loaded with reagents 403. Reagents 403 may be, for example, pellets of lyophilized reagent that will be reconstituted upon contact with sample fluid 201. In other embodiments, appropriate reagents may be placed in the various compartments of cartridge body 101 in a liquid form and then dried, so that the reagents are reconstituted upon contact with liquid flowing into the various compartments. The various reagents may include, for example, pepsin to process the sample, a neutralizer to adjust pH, microparticles coated with antibody for detecting glycated hemoglobin (HbA1c) and total hemoglobin (tHb), microparticles for detecting hemoglobin variants S, C, E, and D (SCED), or other kinds of reagents, depending on the intended use of the cartridge. In the case where cartridge 100 is used in an HbA1c assay, the reagent in compartment 401 may be pepsin.

While reservoir 105 is shown as being joined to cartridge body 101 by a simple linear motion, it will be recognize that many other joining motions and techniques may be used. For example, reservoir 105 may undergo a rotational or sliding motion to connect with cartridge body 101 and to reach hollow piercing elements 113.

Figure 5:
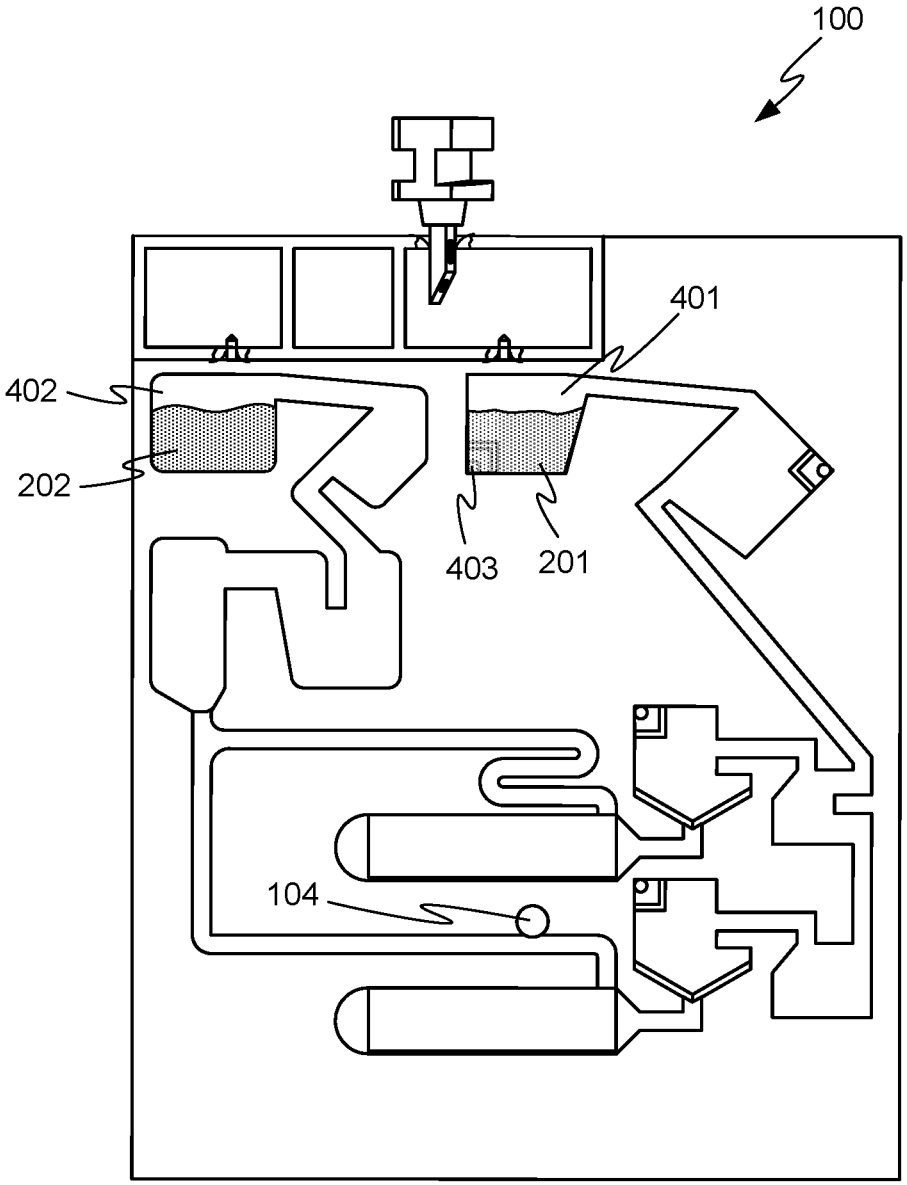
FIG. 5 illustrates a sample fluid and a washing buffer fluid in compartments of an assay cartridge, in accordance with embodiments of the invention.

FIG. 5 shows the state of cartridge 100 after sample fluid 201 and washing buffer fluid 202 have drained into cartridge compartments 401 and 402. During the steps of FIGS. 2-5, cartridge 100 has been held in a first, vertical orientation. Cartridge 100 may be held in this first orientation for a period of time, if desired, to allow sample fluid 201 to react with reagent 403 in compartment 401, depending on the particular test being run.

In some embodiments, one or more compartments may include structures that can aid in mixing of fluids and reagents. For example, as shown in FIG. 5, each of reagent pellets 403 may be housed in a sharp-edged pocket 404. Once sample fluid 201 has reached compartment 401 and is mixing with the reagent pellet, cartridge 100 may be rotated back and forth around axis 104 to agitate sample fluid 201. The sharp edges of the pocket may promote mixing of sample fluid 201 with reagent pellet 403.

Figure 6A:
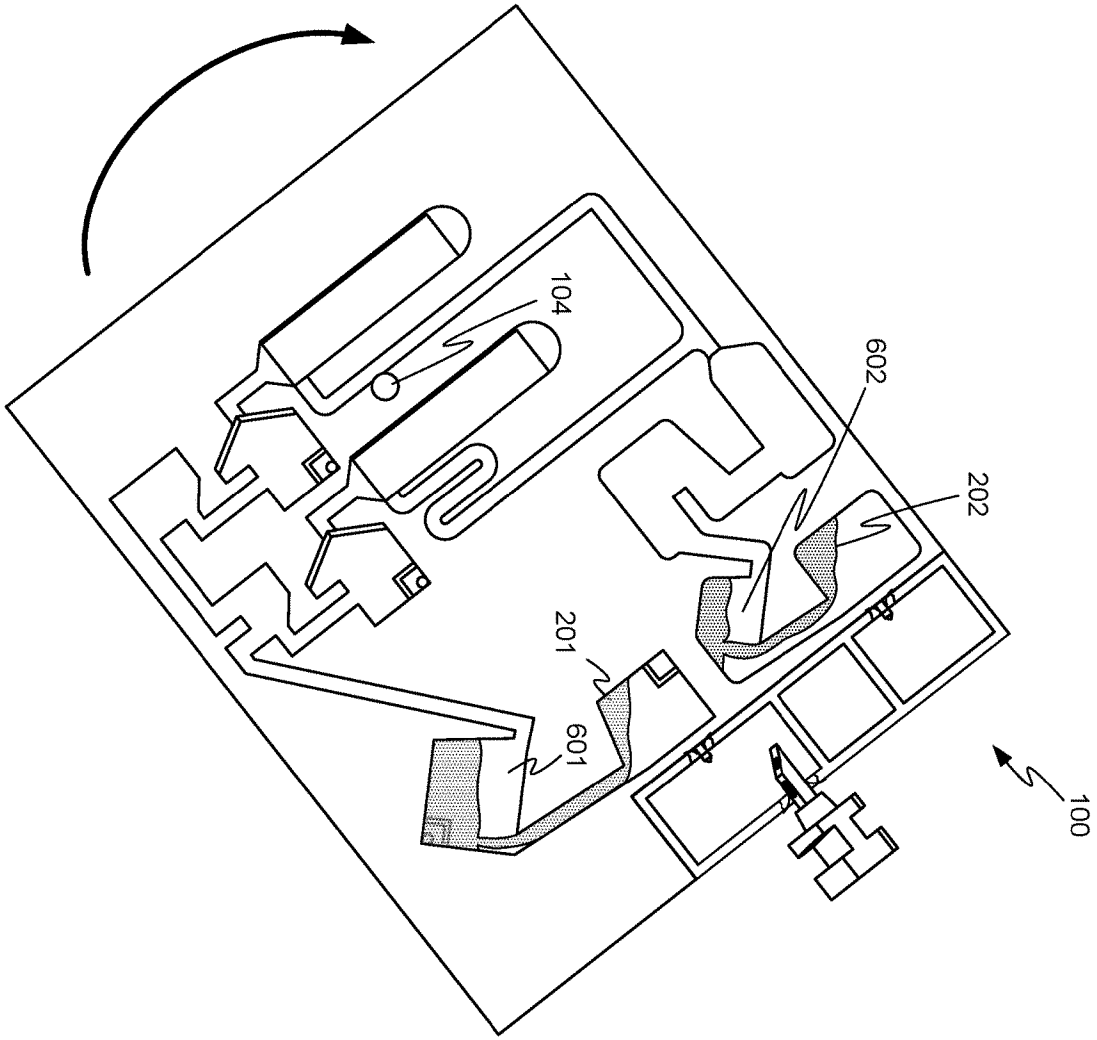
FIGS. 6A and 6B illustrate a rotational motion of the cartridge of FIG. 1 and a resulting fluid motion, in accordance with embodiments of the invention.

In FIG. 6A, cartridge 100 is being rotated about axis 104. The rotation may be accomplished, for example, by a rotary mechanism (not shown) configured to perform a prescribed sequence of rotations in accordance with a specific tests. Preferably, the mechanism is programmable for use with different cartridges for performing different tests, and can perform any required sequence of rotations of cartridge 100.

Figure 6B:
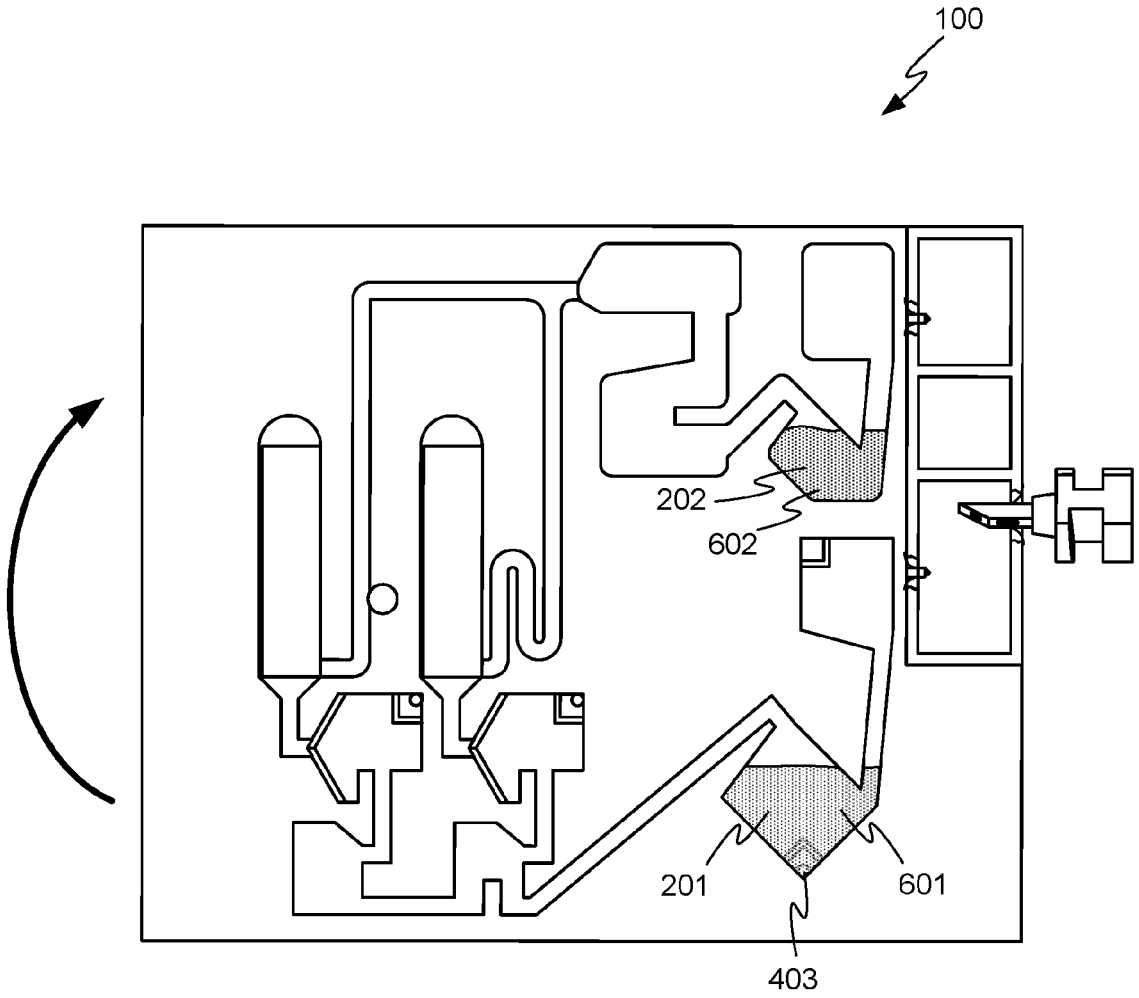
Figure 7:
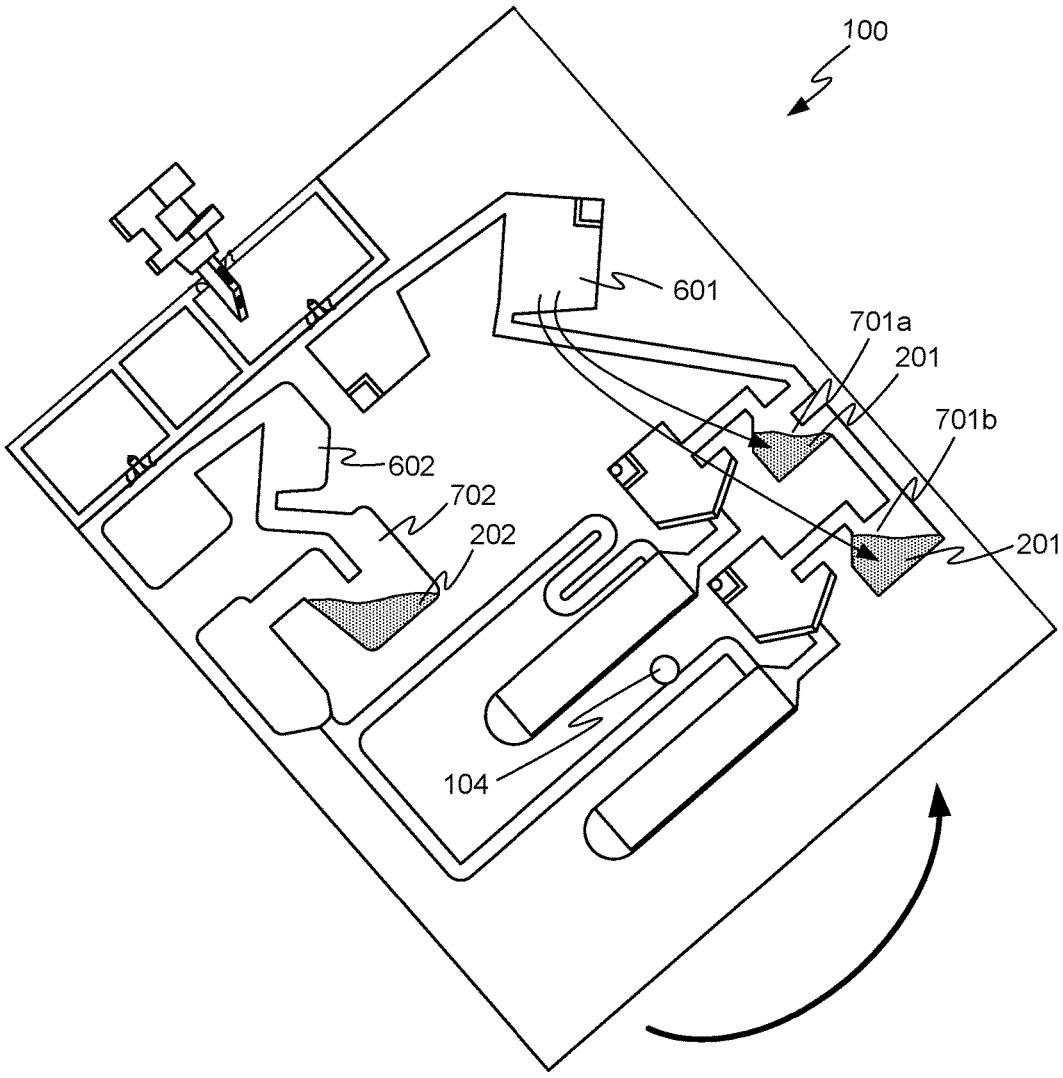
FIG. 7 illustrates another rotational motion of the cartridge of FIG. 1 and resulting fluid motion, in accordance with embodiments of the invention.

In FIG. 6A, sample fluid 201 is spilling into cartridge compartment 601, and washing buffer fluid 202 is spilling into cartridge compartment 602. In FIG. 6B, cartridge 100 has reached an orientation in which the fluids 201 and 202 are held in their respective compartments 601 and 602. Cartridge 100 may be held in this orientation to allow sample fluid 201 to react with reagent 403 in compartment 601, if desired. In the case where cartridge 100 is used in an HbA1c assay, the reagent in compartment 601 may be a neutralizer.

In FIG. 7, cartridge 100 has again been rotated about axis 104, but in the opposite direction from before, spilling fluids 201 and 202 from compartments 601 and 602. Washing buffer fluid 202 has spilled into compartment 702. (The intermediate flow is not shown.) In addition, sample fluid 201 has spilled from compartment 601 into a first fractioning compartment 701*a*. However, first fractioning compartment 701*a* is smaller in volume than the volume of sample fluid 201, and part of sample fluid 201 has overflowed first fractioning compartment 701*a* and flowed to second fractioning compartment 701*b*. Thus, sample fluid 201 has been "fractioned" into two smaller volumes.

Figure 8:
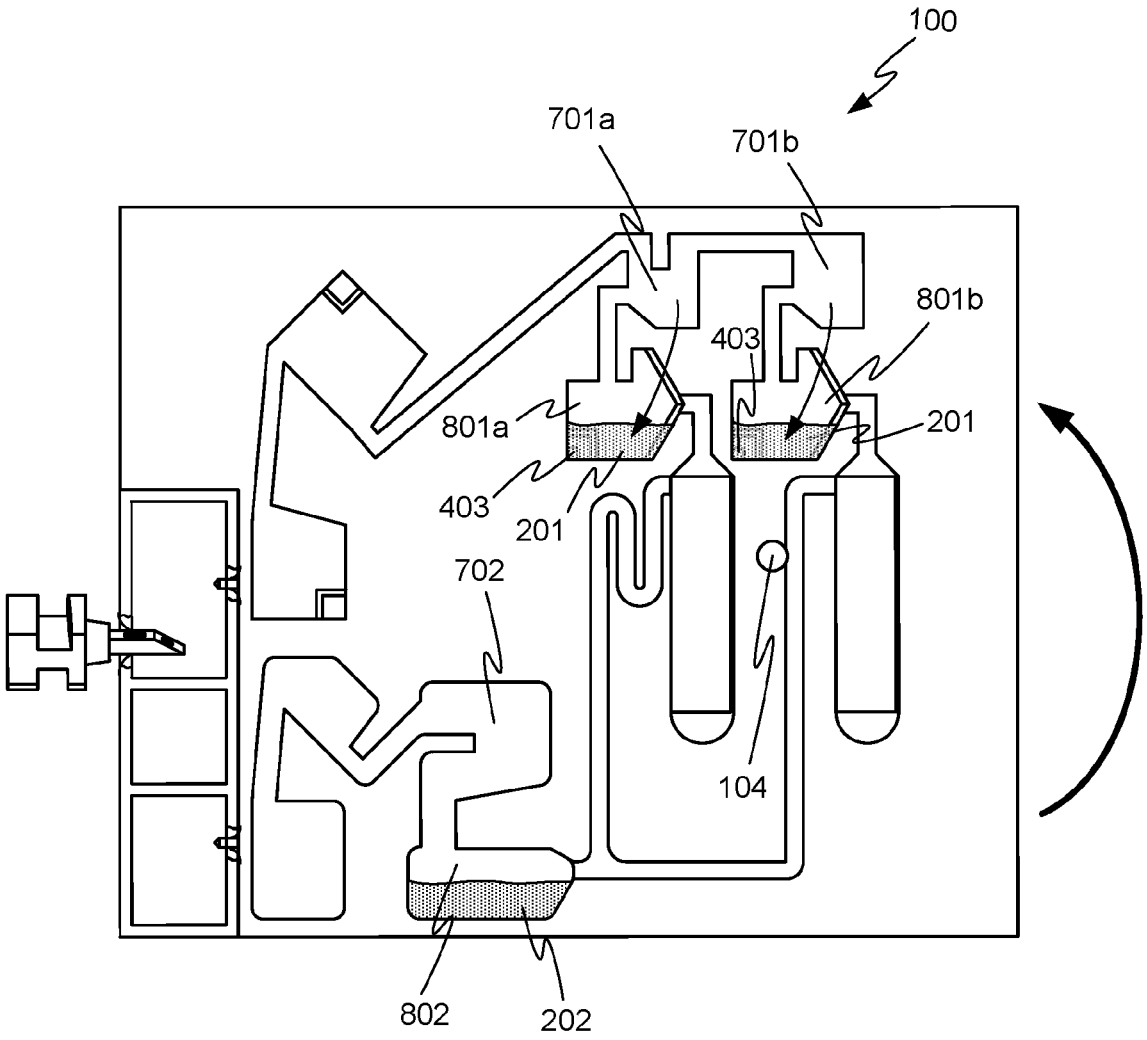
FIG. 8 illustrates another rotational motion of the cartridge of FIG. 1 and resulting fluid motion, in accordance with embodiments of the invention.
Figure 9:
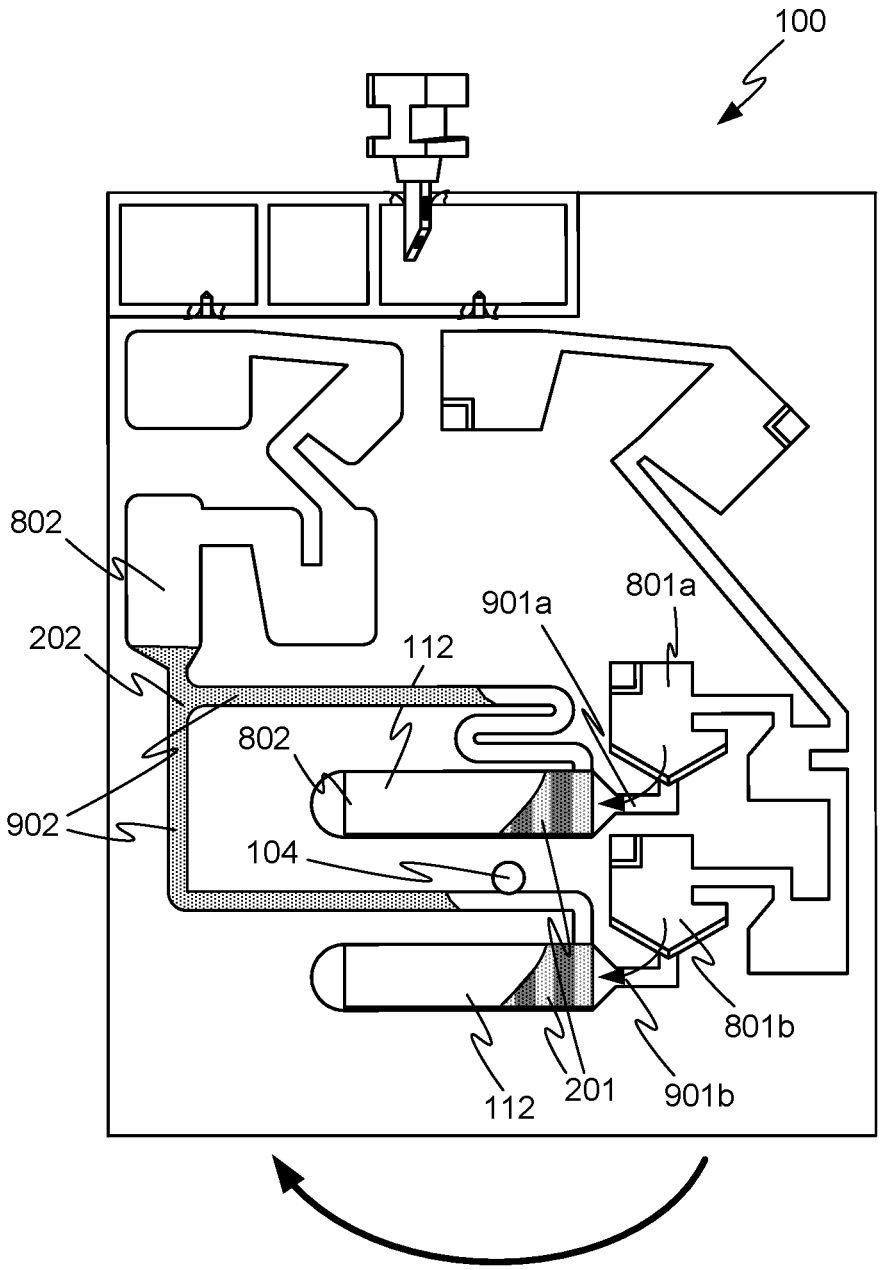
FIG. 9 illustrates another rotational motion of the cartridge of FIG. 1 and resulting fluid motion, in accordance with embodiments of the invention.

In FIG. 8, cartridge 100 has been further rotated to spill sample fluid 201 from fractioning compartments 701*a* and 701*b* into additional compartments 801*a* and 801*b*. There, sample fluid 201 may react with stored reagents 403 if desired. Washing buffer fluid 202 has similarly spilled from compartment 702 into compartment 802. In the case where cartridge 100 is used in an HbA1c assay, the reagent in compartments 801*a* and 801*b* may include A1c and tHb microparticles in one of compartments 801*a* and 801*b*, and SCED microparticles in the other compartment.

In FIG. 9, cartridge 100 has again been rotated about axis 104, so that the two portions of sample fluid 201 spill from compartments 801*a* and 801*b*, and into channels 901*a* and 901*b*, which conduct sample fluid 201 to analysis areas 112. Each analysis area 112 may include, for example, an absorbent medium impregnated with proteins to which the antibodies from sample fluid 201 may attach. The absorbent medium may comprise nitrocellulose or another kind of absorbent medium. Sample fluid 201 may transport across the absorbent medium by capillary wicking action. Different areas of the absorbent medium may be impregnated with different proteins to which different antibodies may attach.

In the meantime, washing buffer fluid 202 has spilled from compartment 802 and into channels 902, to be carried by capillary action toward analysis areas 112 as well. However, because channels 902 are longer than channels 901*a* and 901*b*, washing buffer fluid 202 arrives at analysis areas 112 later than does sample fluid 201. By the time washing buffer fluid 202 arrives at analysis areas 112, sample fluid 201 may have already substantially soaked into the absorbent medium of analysis areas 112, and washing buffer fluid 202 may carry sample fluid 201 further across analysis areas 112. Washing buffer fluid 202 may serve to carry away antibodies not bound to any of the proteins present in analysis areas 112, removing stray antibodies that could otherwise interfere with interpretation of the test result. Washing buffer fluid 202 and other fluid components it carries may be exhausted into a collection area (not shown) within cartridge 100.

Figure 10:
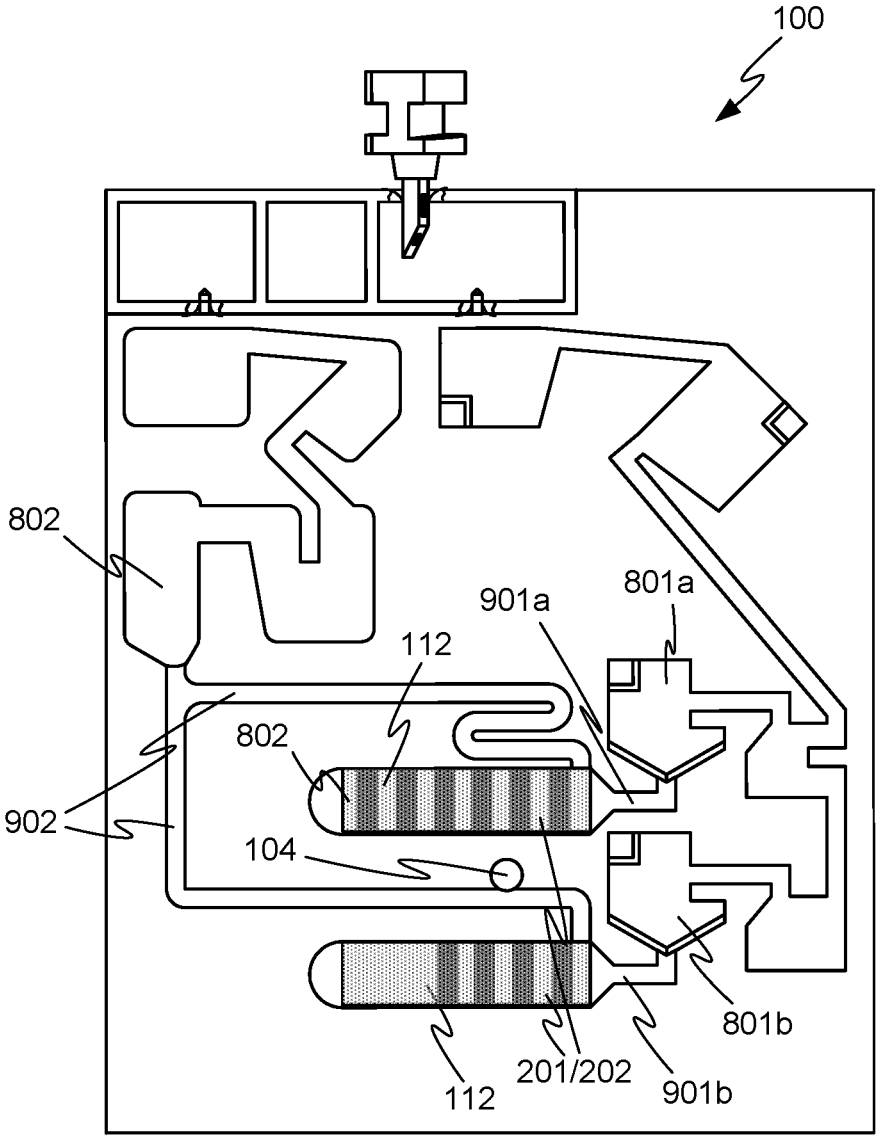
FIG. 10 illustrates a completed fluid flow, in accordance with embodiments of the invention.

FIG. 10 illustrates the completion of the flows of sample fluid 201 and washing buffer fluid 202. To read the result of the test, analysis areas 112 may be illuminated in order to stimulate fluorescence of the fluorphores tagged to the antibodies adhering to the various areas of analysis areas 112. The wavelengths and intensity of light emanating from analysis areas 112 may be measured and interpreted to provide a test result.

It will be recognized that many, many variations from this example are possible within the scope of the appended claims. The number, size, and arrangement of compartments present in a particular cartridge may be varied according to the intended use of the cartridge. Only one set of compartments and channels may be provided, or more than two sets of compartments and channels may be provided, for manipulating more than two fluids. Different kinds of analysis areas may be provided, according to the intended use of the cartridge. And while only two fractioning compartments are shown in the above example, it will be recognized that three or more fractioning compartments may be provided, so that a fluid sample can be divided in to any workable number of smaller quantities for performing different tests or for other purposes.

Figure 11:
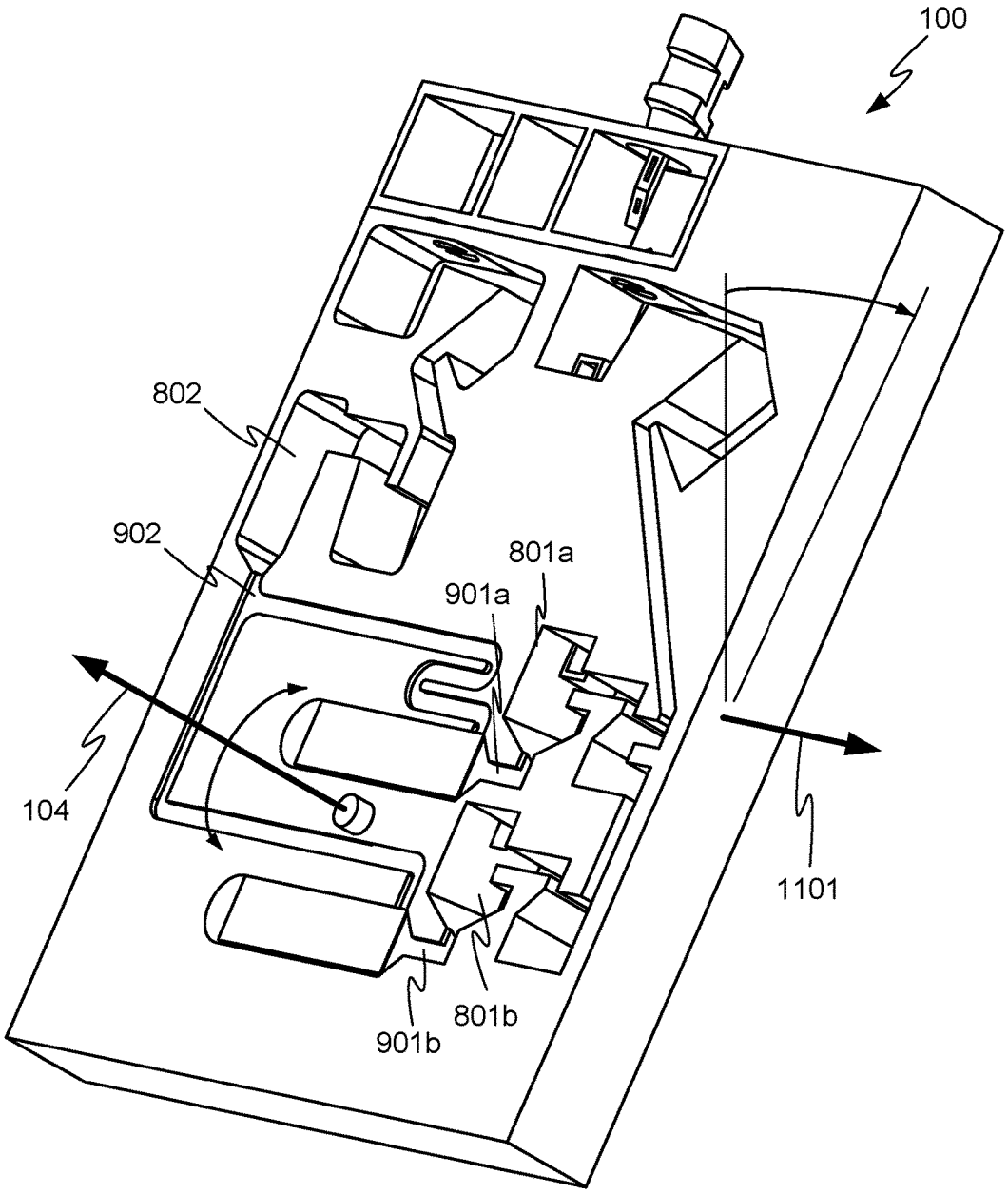
FIG. 11 illustrates an additional degree of freedom of rotation of the cartridge of FIG. 1, in accordance with embodiments of the invention.

In some embodiments, and additional axis of rotation of cartridge 100 may be provided. For example, the rotation mechanism that provides rotations of cartridge 100 about axis 104 may also include a second rotational degree of freedom as shown in FIG. 11, in which cartridge 100 can also rotate about axis 1101, orthogonal to axis 104. Motions in this additional degree of freedom may be used for additional agitation of fluids and reactants, to control the flow of fluids within cartridge 100, or for other purposes. For example, cartridge 100 may tilted "back" (in the direction shown in FIG. 11) to retain some fluid in compartments 801*a*, 801*b*, and 802 rather than letting all of the fluid flow to shallow channels 901*a*, 901*b*, and 902. In another example, a controlled tilting motion in the "forward" direction (opposite the tilt shown in FIG. 11) may be used to slowly meter fluid into channels 901*a*, 901*b*, and 902 from compartments 801*a*, 801*b*, and 802.

An assay cartridge such as cartridge 100 may be particularly useful in a point-of-care or field hospital environment, because the motions required for completing an assay are simple and easily accomplished. For example, especially when cover 108 is transparent, the rotational motions and test sequence described in conjunction with FIGS. 2-10 may be accomplished without any additional mechanism or machinery at all. A user may simply move cartridge 100 by hand, observing the fluid flow from one compartment to the next, and holding cartridge 100 in each orientation for a prescribed amount of time. If analysis areas 112 provide a visual result, the test result may be read directly from analysis areas 112 through cover 108, possibly with the aid of a light source to stimulate fluorescence. Cartridge 100 may be made of low-cost materials, for example molded polymers or the like, and thus may be disposable.

Figure 12:
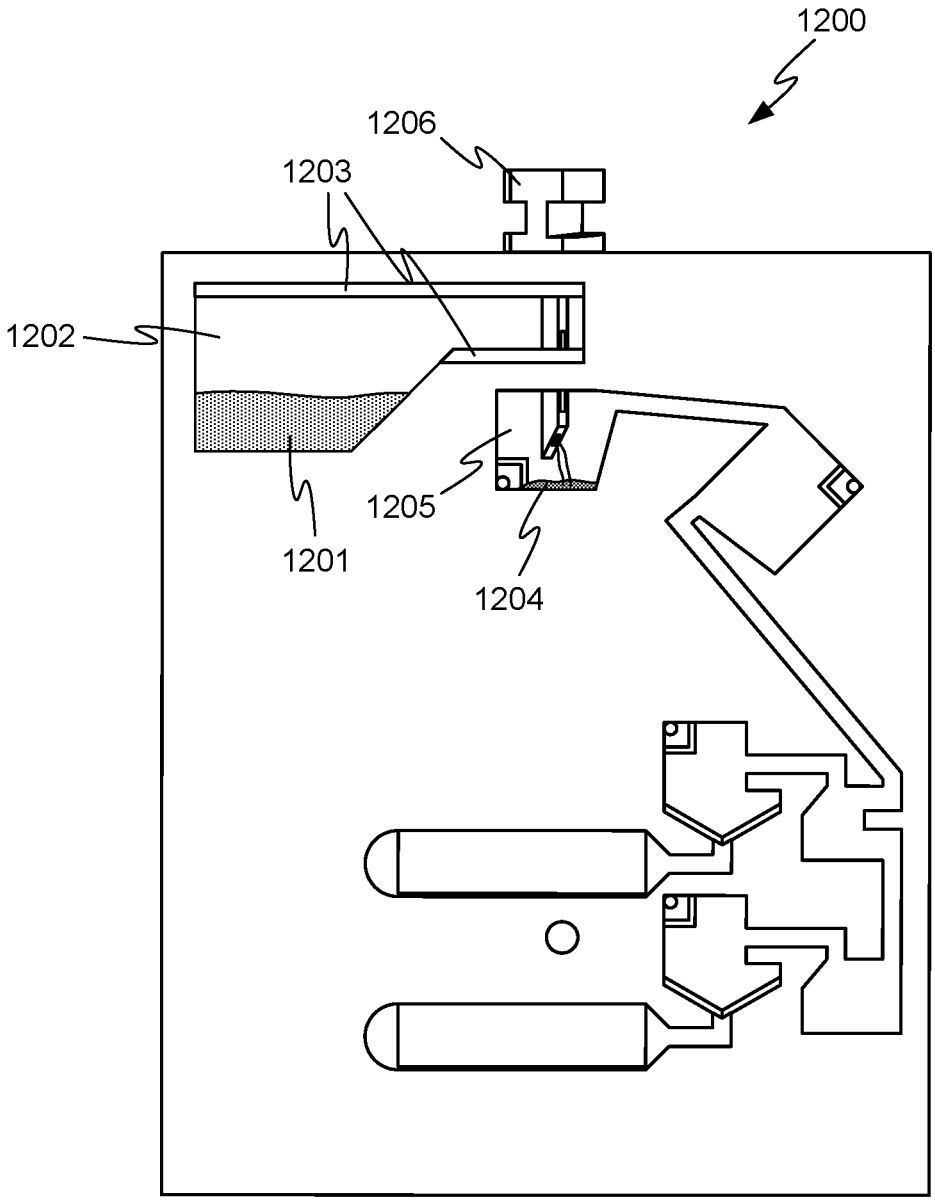
FIG. 12 illustrates a cartridge for fluid manipulation, in accordance with other embodiments of the invention.

FIG. 12 illustrates an assay cartridge 1200 in accordance with another embodiment. Cartridge 1200 differs from cartridge 100 in its technique of sample loading, and in that it includes only one set of compartments and channels for manipulating a single fluid, rather than two sets for manipulating two fluids as in cartridge 100. Example cartridge 1200 is otherwise similar to cartridge 100, and is therefore shown only in a face-on view.

In cartridge 1200, a sample fluid 1201 may be pre-loaded in a compartment 1202 of cartridge 1200 itself, rather than in a separate reservoir. Compartment 1202 may be lined with puncturable seals 1203. An analyte 1204 may be introduced directly into compartment 1205, for example using a sample injector or needle 1206.

Figure 13:
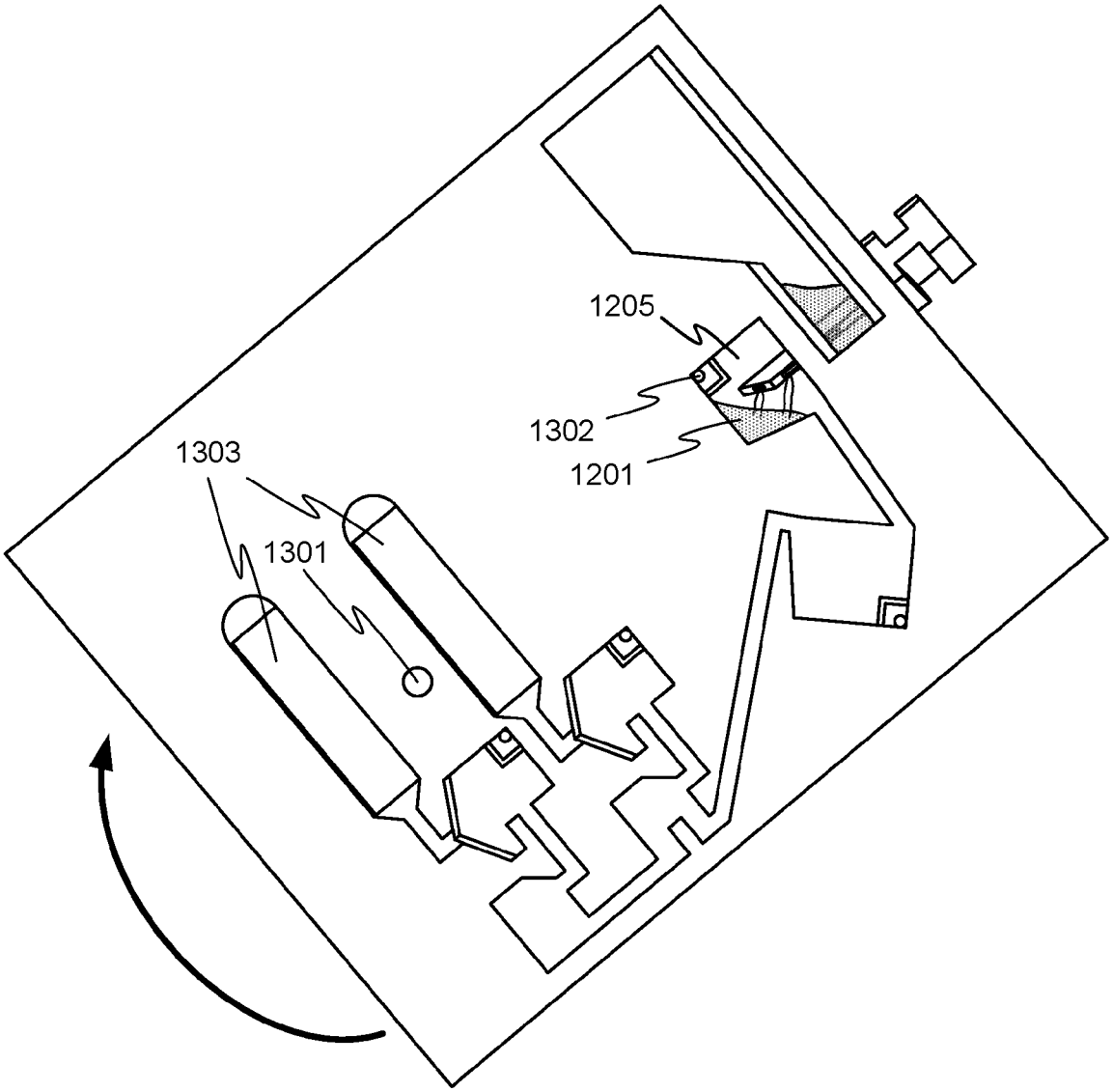
FIG. 13 illustrates a rotational motion of the cartridge of FIG. 12 and a resulting fluid motion, in accordance with embodiments of the invention.

As shown in FIG. 13, cartridge 1200 may then be rotated about axis 1301 to allow sample fluid 1201 to spill into compartment 1205, for example though a slot in sample injector 1206, or through the opening in lower puncturable seal 1203 after sample injector 1206 has been partially or completely withdrawn. Once compartment 1205 has received sample fluid 1201, sample fluid 1201 may react with a reagent such as reagent 1302, and cartridge 1200 may be subjected to a series of rotations similar to the steps of FIGS. 6A-10, to bring sample fluid 1201 (with analyte 1204) to analysis areas 1303.

Figure 14:
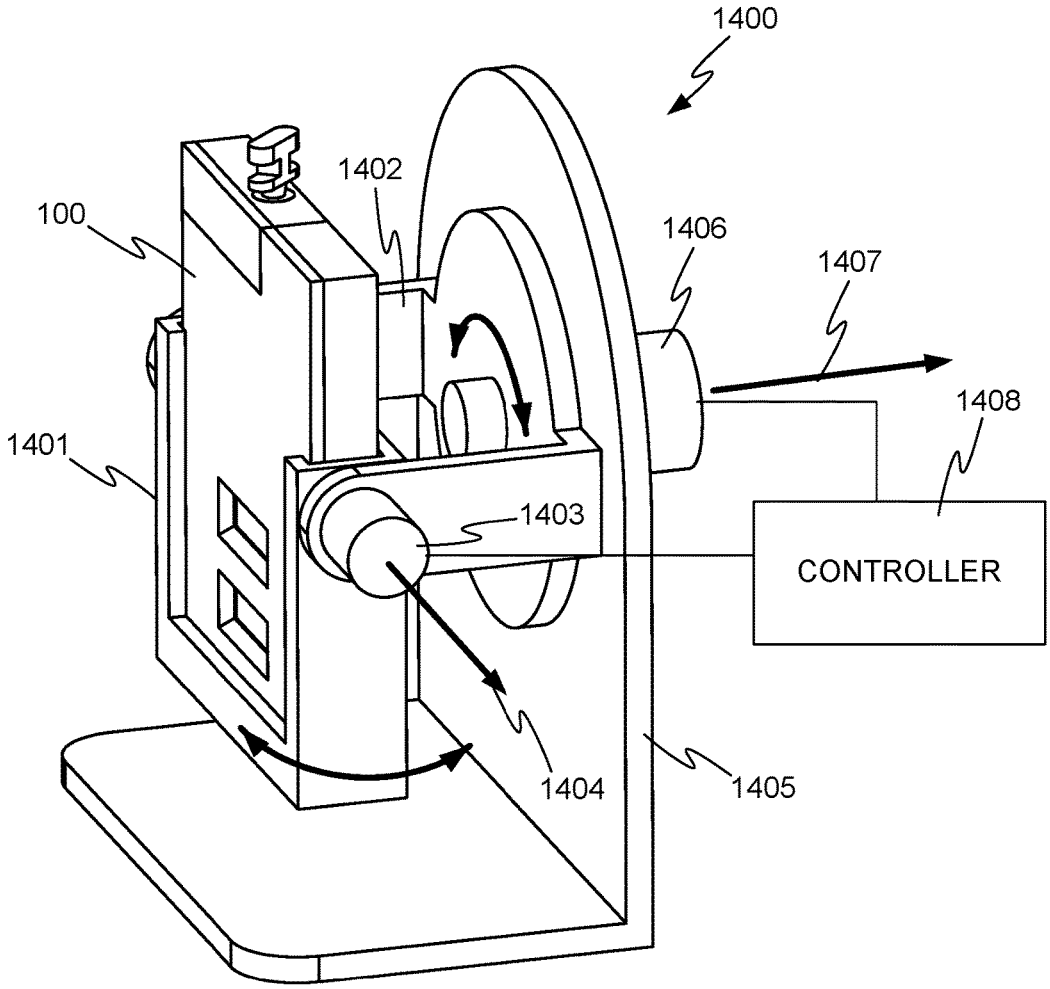
FIG. 14 illustrates a schematic view of a system for performing an assay using a cartridge such as the cartridge of FIG. 1 or the cartridge of FIG. 12, in accordance with embodiments of the invention.

FIG. 14 illustrates a schematic view of a system 1400 for performing an assay using a cartridge such as cartridge 100, in accordance with embodiments of the invention. In example system 1400, cartridge 100 is slid into a holder 1401. Cartridge 100 may be retained in holder 1401 by friction, or by a latching mechanism (not shown) of any suitable design. Holder 1401 is in turn rotationally coupled to a yoke 1402. A motor 1403 may be provided for automatically turning holder (and cartridge 100) within yoke 1402 about axis 1404. Yoke 1402 is rotationally coupled to a base 1405. A second motor 1406 may be provided for automatically turning yoke (and holder 1401 and cartridge 100) about axis 1407. Axes 1404 and 1407 may be orthogonal to each other, although this is not a requirement. A controller 1408 is coupled to motors 1403 and 1406, and is programmed to cause cartridge 100 to be subjected to a sequence of rotational motions about either or both of axes 1404 and 1407, to accomplish a particular test or assay using cartridge 100. Controller 1408 may include selectable programs for performing a number of different tests and assays, using a number of different cartridge types. Any or all parts of the mechanism of FIG. 14 may be embedded in a testing instrument.

In the claims appended hereto, the term "a" or "an" is intended to mean "one or more." The term "comprise" and variations thereof such as "comprises" and "comprising," when preceding the recitation of a step or an element, are intended to mean that the addition of further steps or elements is optional and not excluded.

It is to be understood that any workable combination of the elements and features disclosed herein is also considered to be disclosed.

The invention has now been described in detail for the purposes of clarity and understanding. However, those skilled in the art will appreciate that certain changes and modifications may be practiced within the scope of the appended claims.

What is claimed is:

1. A cartridge for fluid manipulation, the cartridge comprising:

a cartridge body defining a holding compartment and first and second fractioning compartments formed within the cartridge body, and the cartridge body defining a number of flow channels formed within the cartridge body, the compartments and flow channels configured such that, when the cartridge body is held in a first vertical orientation, a predetermined quantity of fluid can be held in the holding compartment, and such that the predetermined quantity of fluid can be poured from the holding compartment to the first fractioning compartment by rotating the cartridge body about a predefined rotation axis to a second vertical orientation, to spill the fluid from the holding compartment to the first fractioning compartment through a first one of the flow channels;

a separate reservoir comprising two reservoir compartments, the reservoir mateable to the cartridge body to supply fluids to the cartridge body;

and wherein the first fractioning compartment is of a shape, size, and position such that when the cartridge body is held in the second vertical orientation, not all of the predetermined quantity of fluid can be contained in the first fractioning compartment, and wherein the first fractioning compartment is connected to the second fractioning compartment by a second one of the flow channels, and wherein the compartments and flow channels are configured such that any of the fluid that overflows the first fractioning compartment when the cartridge body is held in the second orientation flows through the second flow channel to the second fractioning compartment;

and wherein the cartridge further comprises two analysis areas, one analysis area respectively for each fractioning compartment, each of the analysis areas including a respective absorbent medium, and wherein the analysis areas are connected directly or indirectly to the respective fractioning compartments by respective ones of the flow channels, and the analysis areas are positioned such that fluid held in the fractioning compartments, when the cartridge body is in the second orientation, can be delivered to the respective analysis areas by one or more subsequent rotations of the cartridge body about the rotation axis, to spill fluid from the fractioning compartments and into the respective connections to the analysis areas to transport across the absorbent medium of the respective analysis area by capillary wicking action.

2. The cartridge of claim 1, wherein the first and second fractioning compartments are shaped, sized, and positioned such that the predetermined quantity of fluid can be held in substantially equal quantities in the first and second fractioning compartments when the cartridge body is held in the second vertical orientation.

3. The cartridge of claim 1, wherein:

the cartridge body defines a third fractioning compartment;

the first and second fractioning compartments are shaped, sized, and positioned such that the predetermined quantity of fluid cannot be contained within the first and second fractioning compartments when the cartridge body is held in the second vertical orientation; and the second fractioning compartment is connected by a third one of the flow channels to the third fractioning compartment, such that any of the fluid that overflows the second fractioning compartment when the cartridge body is held in the second vertical orientation flows through the third flow channel to the third fractioning compartment.

4. The cartridge of claim 3, wherein the first, second, and third fractioning compartments are shaped, sized, and positioned such that the predetermined quantity of fluid can be held in substantially equal quantities in the first, second, and third fractioning compartments when the cartridge body is held in the second vertical orientation.

5. The cartridge of claim 1, wherein the cartridge body further defines two mixing compartments, one mixing compartment respectively for each fractioning compartment, and wherein the fluid spilled from the fractioning compartments passes through the respective mixing compartments before reaching the respective analysis areas.

6. The cartridge of claim 5, wherein each of the mixing compartments stores a quantity of a reagent positioned to mix with the fluid spilled from the respective fractioning compartment before the fluid flows to the respective analysis area.

7. The cartridge of claim 1, wherein:

the fluid is a first fluid;

the cartridge body further defines a second set of compartments and flow channels for manipulating a second fluid in sequence through the second set of compartments in reaction to the rotations of the cartridge about the rotation axis and the holding of the cartridge in the first and second vertical orientations;

the cartridge body further defines a second set of outlet channels respectively connecting the last of the second set of compartments with the analysis areas; and the second set of compartments and flow channels and the outlet channels are shaped, sized, and positioned such that the second fluid reaches the analysis areas later than the first fluid when the cartridge is rotated in such a way as to deliver the first fluid to the analysis areas.

8. The cartridge of claim 7, wherein the lengths of the outlet channels are selected to ensure that the second fluid will reach the analysis areas later than the first fluid.

9. A cartridge for fluid manipulation, the cartridge comprising a cartridge body and a separate reservoir, wherein:

the cartridge body defines a first set of compartments and flow channels for manipulating a first fluid, the compartments and channels in the first set sized, shaped, and positioned such that a sequence of rotations of the cartridge body about a predefined rotation axis to a number of vertical orientations in which the cartridge body is held will cause a quantity of the first fluid to sequentially pass through all of the compartments in the first set via the first set of flow channels to reach an outlet of the first set of compartments and flow channels;

the cartridge body defines a second set of compartments and flow channels for manipulating a second fluid, the compartments and channels in the second set sized, shaped, and positioned such that the same sequence of rotations of the cartridge body about the predefined rotation axis causes a quantity of the second fluid to sequentially pass through all of the compartments in the second set via the second set of flow channels to reach an outlet of the second set of compartments and flow channels;

the outlets of the first and second sets of compartments and flow channels are joined at a junction;

the first and second sets of compartments and flow channels are shaped, sized, and positioned such that the second fluid reaches the junction at a different time than the first fluid in response to the sequence of rotations;

the cartridge comprises an analysis area at the junction, the analysis area including an absorbent medium, and wherein the analysis area is positioned such that fluid output from the junction is delivered to the absorbent medium, to transport across the absorbent medium by capillary wicking action; and the reservoir comprises two reservoir compartments, and the reservoir is mateable to the cartridge body to supply fluids to the cartridge body.

10. The cartridge of claim 9, wherein the reservoir holds a sample fluid and a washing buffer fluid in respective compartments of the reservoir, the reservoir including two openings sealed by puncturable sealing covers; and two hollow piercing elements positioned on the cartridge body such that the two piercing elements pierce the puncturable sealing covers of the reservoir when the reservoir is joined to the cartridge body, enabling the sample fluid and the washing buffer fluid to pass through the two hollow piercing elements and to pass respectively to the first set of compartments and flow channels and the second set of compartments and flow channels, the sample fluid being the first fluid and the washing buffer fluid being the second fluid; and wherein at least some of the compartments in the first set of compartments store quantities of reagents for mixing with the sample fluid as the sample fluid traverses the first set of compartments and flow channels, the reagents usable to conduct an assay of the sample fluid;

and wherein the analysis area enables reading of a result of the assay.

11. A testing system, comprising:

a cartridge for fluid manipulation as in claim 1;

a motorized mechanism for producing a rotary motion of cartridge about a rotational axis; and a controller having a processor and memory, the controller coupled to the motorized mechanism and programmed to cause the motorized mechanism to produce a predetermined series of rotations of the cartridge in accordance with a predetermined assay.

12. A method of conducting an assay, the method comprising:

providing a cartridge having a cartridge body defining a holding compartment and first and second fractioning compartments formed within the cartridge body, the cartridge body also defining a number of flow channels formed within the cartridge body, and the cartridge further comprising two analysis areas, one analysis area respectively for each of the first and second fractioning compartments, each of the analysis areas including an absorbent medium;

mating a separate reservoir to the cartridge body to supply fluids to the cartridge body, the reservoir comprising two reservoir compartments;

placing a quantity of fluid in the holding compartment and holding the cartridge body in a first vertical orientation;

rotating the cartridge about a predefined rotation axis to a second vertical orientation and holding the cartridge body in the second vertical orientation for a prescribed period of time to pour at least some of the fluid from the holding compartment through a first one of the flow channels to the first fractioning compartment, wherein the first fractioning compartment is of a shape, size, and position such that when the cartridge body is in the second orientation, not all of the fluid can be contained in the first fractioning compartment, and wherein the first fractioning compartment is connected to the second fractioning compartment by a second one of the flow channels, such that any of the fluid that overflows the first fractioning compartment when the cartridge body is held in the second vertical orientation flows by gravity through the second flow channel to the second fractioning compartment; and rotating the cartridge about the rotation axis to one or more subsequent vertical orientations, causing the fluid to spill from the first and second fractioning compartments to the respective analysis areas, where the fluid can transport through the respective absorbent medium by capillary action.

13. The method of claim 12, further comprising pausing between successive rotations of the cartridge to allow an analyte in the fluid to react with a reagent previously stored in one of the compartments.

14. The method of claim 12, wherein the rotation axis is a first rotation axis, the method further comprising rotating the cartridge about a second rotation axis different from the first.

15. The method of claim 12, further comprising depositing an analyte in the quantity of fluid.

16. The method of claim 15, wherein depositing the analyte in the quantity of fluid comprises injecting the analyte through a puncturable seal.

* * * * *